US008827330B2

(12) United States Patent
Jankowski et al.

(10) Patent No.: US 8,827,330 B2
(45) Date of Patent: Sep. 9, 2014

(54) SAFETY LOCKING DEVICE FOR VEHICLE DOOR

(75) Inventors: Krystof Peter Jankowski, Waterford, MI (US); James Joseph Loschiavo, Livonia, MI (US); Lynn DaDeppo, Bloomfield Hills, MI (US)

(73) Assignee: Magna Closures Inc, Newmarket, Ontario (CA)

( * ) Notice: Subject to any disclaimer, the term of this patent is extended or adjusted under 35 U.S.C. 154(b) by 837 days.

(21) Appl. No.: 12/793,061

(22) Filed: Jun. 3, 2010
(Under 37 CFR 1.47)

(65) Prior Publication Data

US 2011/0133495 A1 Jun. 9, 2011

Related U.S. Application Data

(60) Provisional application No. 61/183,632, filed on Jun. 3, 2009.

(51) Int. Cl.
*E05B 3/00* (2006.01)

(52) U.S. Cl.
USPC ..... 292/336.3; 292/216; 292/DIG. 23

(58) Field of Classification Search
USPC ..... 292/336.3, 216, DIG. 23
See application file for complete search history.

(56) References Cited

U.S. PATENT DOCUMENTS 6,116,664 A 9/2000 Wegner
6,497,426 B2 * 12/2002 VanPelt ..... 280/287
6,705,649 B1 * 3/2004 Reddmann ..... 292/216

* cited by examiner

*Primary Examiner* — Mark Williams

(57) ABSTRACT

In a first aspect, the invention is directed to a closure latch for a vehicle closure panel, having at least three lock states all of which are achieved using a single control member. The control member may be movable to at least three positions to achieve the lock states. A single motor may be used to move the control member between the positions. In a second aspect, the invention is directed to a closure latch that is movable to a safety locking position, wherein the inside and outside door levers are disabled and wherein the pawl is prevented from releasing the ratchet. The safety locking position may be used when the vehicle controller senses an impending crash or that a crash is occurring as a way of inhibiting inadvertent opening of the vehicle closure panel (e.g. a vehicle door). After the crash, if it is desired to exit the vehicle, structure may be provided that permits an occupant to move the inside door lever once to move the pawl blocking member to the pawl unblocking position and a second time to open the vehicle closure panel.

7 Claims, 13 Drawing Sheets

SAFETY LOCKING DEVICE FOR VEHICLE DOOR

This application claims the benefits of U.S. Provisional Application No. 61/183,632, filed Jun. 3, 2009.

FIELD OF THE INVENTION

The present invention relates to a closure latch for a vehicle closure panel, and more particularly to a closure latch for a vehicle closure panel having several different lock states.

BACKGROUND OF THE INVENTION

A typical closure latch for a vehicle door includes a ratchet that rotates from an open position to a closed position to hold a striker. A pawl holds the ratchet in its closed position. An inside door lever and an outside door lever may be provided each of which can be used to move the pawl to release the ratchet, thereby opening the vehicle door. With respect to the inside and outside door levers, there are several lock states that are possible. For example, if only inside door lever is disabled, it corresponds to a lock state wherein the child lock is engaged (for a rear door of a vehicle). If only the outside door lever is disabled, it corresponds to a traditional lock state wherein the vehicle door is locked (for either a rear or front door of a vehicle).

In some closure latches, two or more motors and relatively complex mechanisms are used to achieve a number of different lock states. It would be advantageous if a closure latch was provided with a relatively simple mechanism and with a reduced number of motors to achieve a plurality of lock states.

Separately, a problem with some closure latches is that they can at least theoretically open during a vehicle crash due to impact related forces present during the crash (e.g. inertia, system deformation, etc.). It would be desirable to provide a closure latch that includes a safety lock state that would inhibit a door from opening inadvertently during a vehicle crash.

SUMMARY OF THE INVENTION

In a first aspect, the invention is directed to a closure latch for a vehicle closure panel, having at least three lock states all of which are achieved using a single control member. The control member may be movable to at least three positions to achieve the lock states. A single motor may be used to move the control member between the positions.

In a particular embodiment of the first aspect, the invention is directed to a closure latch for a vehicle closure panel, comprising a ratchet, a pawl and a control member. The ratchet is movable between an open position and a closed position. The pawl is movable between a ratchet release position and a ratchet locking position. The control member is positionable in at least three positions corresponding to at least three different states of operative connection between two door levers and the pawl. The two door levers include an outside door lever and an inside door lever. A single motor may optionally be provided to move the control member between the at least three positions.

In a second aspect, the invention is directed to a closure latch that is movable to a safety locking position, wherein the inside and outside door levers are disabled and wherein the pawl is prevented from releasing the ratchet. The safety locking position may be used when the vehicle controller senses an impending crash or that a crash is occurring as a way of inhibiting inadvertent opening of the vehicle closure panel (e.g. a vehicle door). After the crash, if it is desired to exit the vehicle, structure may be provided that permits an occupant to move the inside door lever once to move the pawl blocking member to the pawl unblocking position and a second time to open the vehicle closure panel.

In a particular embodiment of the second aspect, the invention is directed to a closure latch for a vehicle closure panel, comprising a ratchet, a pawl, an inside door lever, an outside door lever, a control member and a pawl blocking member. The ratchet is movable between an open position and a closed position. The ratchet is biased towards the open position. The pawl is movable between a ratchet release position and a ratchet locking position. The pawl is biased towards the ratchet locking position. The inside door lever and the outside door lever are each movable between a pawl engagement position wherein the respective door lever is operatively connected to the pawl, and a pawl non-engagement position wherein the respective door lever is operatively unconnected to the pawl. The pawl blocking member is movable between a pawl blocking position and a pawl unblocking position. In the pawl blocking position the control member moves the inside and outside door levers to the pawl non-engagement position and the pawl blocking lever is moved by the control member to block the pawl from releasing the ratchet. In the pawl unblocking position the control member is positioned to permit movement of the inside and outside door levers to the pawl engagement positions, and wherein the pawl blocking member is moved to permit movement of the pawl to the ratchet release position. The pawl blocking member may be used to provide the safety locking position for the vehicle latch.

BRIEF DESCRIPTION OF THE DRAWINGS

The present invention will now be described by way of example only with reference to the attached drawings, in which.

DETAILED DESCRIPTION OF THE INVENTION

Figure 1:
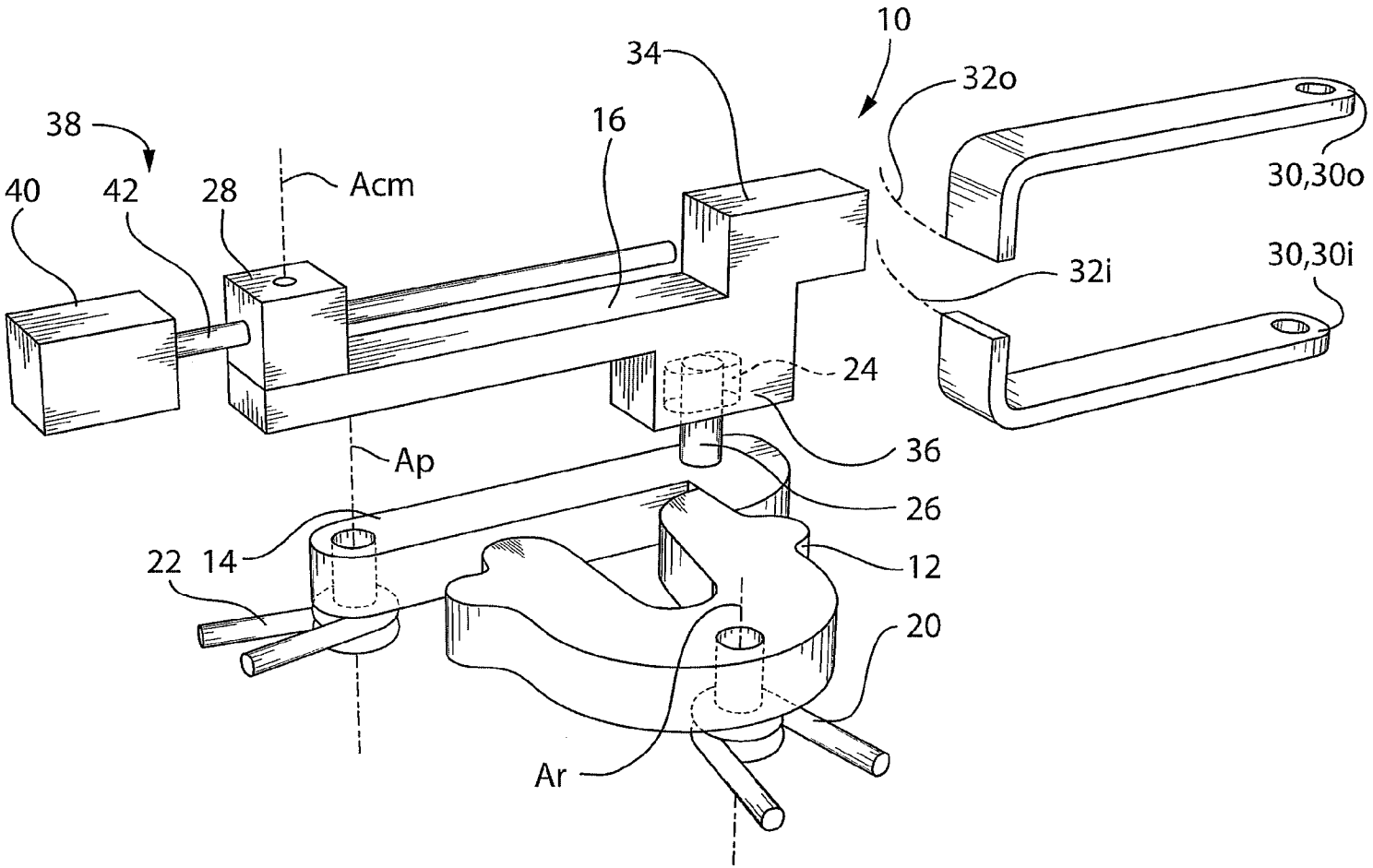
FIG. 1 is a perspective view of a closure latch for a vehicle closure panel in accordance with an embodiment of the present invention.
Figure 2A:
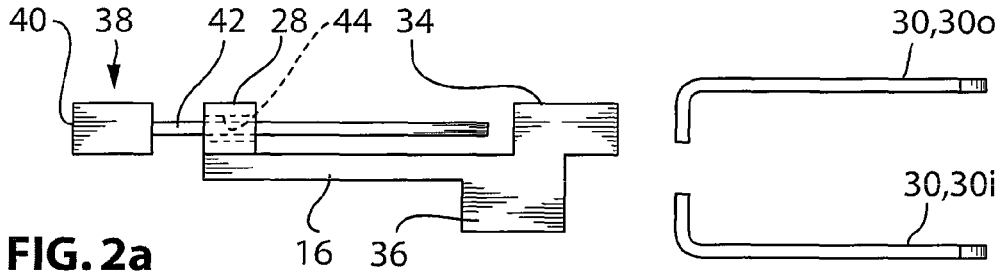
FIGS. 2*a*-2*e* are side views of the closure latch shown in FIG. 1, illustrating different positions of the closure latch.
Figure 2B:
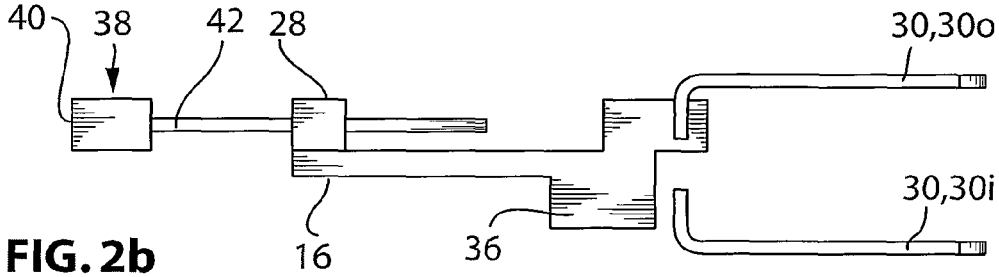
Figure 2C:
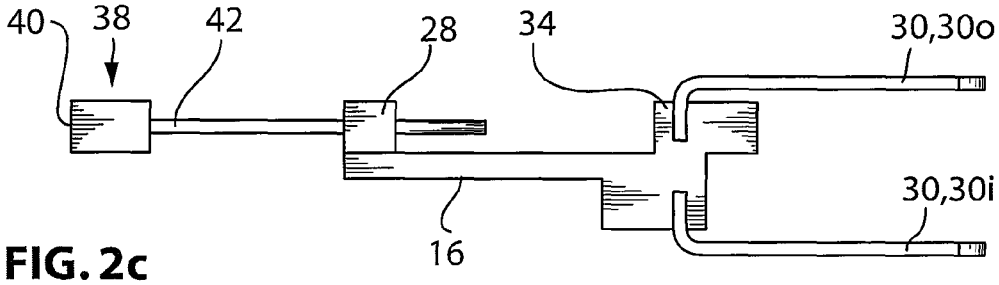
Figure 2D:
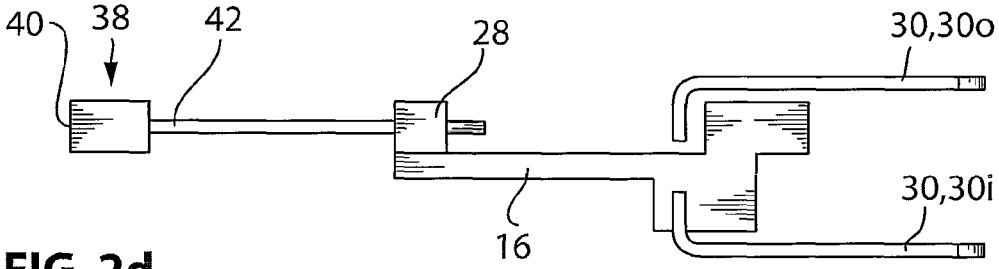
Figure 2E:
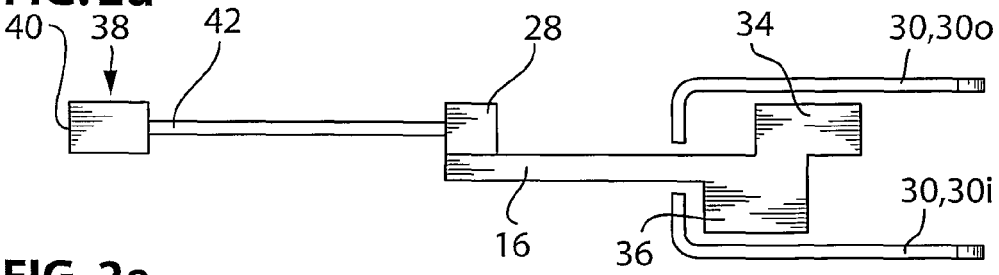

Reference is made to FIG. 1, which shows a portion of a closure latch 10 for a vehicle closure panel (not shown), in accordance with an embodiment of the present invention. The closure panel could be any suitable closure panel, such as a door, a liftgate or a tailgate.

The closure latch 10 incorporates a relatively simple mechanism to achieve the functions of providing a door lock, a child lock and a double lock. The closure latch 10 includes a ratchet 12, a pawl 14 and a control member 16. The ratchet 12 is movable between a closed position (FIG. 1) wherein the ratchet 12 is positioned to retain a striker (not shown) and an open position (not shown) wherein the ratchet 12 is positioned to release the striker. The movement of the ratchet 12 may be rotary about a ratchet pivot axis Ar. The ratchet 12 may be biased towards the open position by a ratchet biasing member 20, which may be any suitable type of biasing member, such as for example, a torsion spring.

The pawl 14 is movable between a ratchet locking position (FIG. 1) wherein the pawl 14 holds the ratchet 12 in the closed position and a ratchet unlocking position (not shown) wherein the pawl 14 permits the ratchet 12 to move to the open position. The movement of the pawl 14 may be rotary about a pawl pivot axis Ap. The pawl 14 may be biased towards the ratchet locking position by a pawl biasing member 22, which may be any suitable type of biasing member, such as for example, a torsion spring.

The control member 16 may be operatively connected to the pawl 14. In the embodiment shown in FIG. 1, the control member 16 has a slot 24 thereon, which receives a drive pin 26 that is positioned on the pawl 14. The control member 16 may be pivotably connected to a linearly movable member 28 about a control member pivot axis, Acm.

The control member 16 is positionable in at least three positions corresponding to three different states of operative connection between two door levers 30 and the pawl 14. The different states of operative connection are also referred to herein as lock states. The two door levers 30 may include an inside door lever 30*i* and an outside door lever 30*o*. A front door of a vehicle may have several lock states including for example, a first lock state in which a door lock is locked and a double lock is unlocked. In the first lock state, the outside door handle 30*o* is disabled, and the inside door handle 30*i* is enabled to open the door. A second lock state exists when the door lock is locked and the double lock is locked. In the second lock state, both the outside and inside door handles 30*o* and 30*i* are disabled. A third lock state exists when the door lock is unlocked and the double lock is unlocked, and therefore both the inside and outside door handles 30*i* and 30*o* are enabled. For a rear vehicle door a first lock state exists when a door lock is locked and a child lock is unlocked. In the first lock state, the outside door handle 30*o* is disabled, and the inside door handle 30*i* is enabled (i.e. able to be used to open the door). A second lock state exists when the door lock is locked and the child lock is locked. In the second lock state, both the outside and inside door handles 30*o* and 30*i* are disabled. A third lock state exists when the door lock is unlocked and the child lock is unlocked, and therefore both the inside and outside door handles 30*i* and 30*o* are enabled. A fourth lock state exists when the child lock is locked and the door lock is unlocked, and therefore the inside handle 30*i* is disabled and the outside handle 30*o* is enabled.

The inside door lever 30*i* is movable from an inside door lever rest position (FIG. 1) along an inside door lever path 32*i* to an inside door lever actuation position (not shown). The outside door lever 30*o* is movable from an outside door lever rest position (FIG. 1) along an outside door lever path 32*o* to an outside door lever actuation position (not shown).

In the embodiment shown in FIG. 1, the control member 16 has a first profile 34 and a second profile 36 and is positionable in five positions, wherein each position determines which, if any, of the first and second profiles 34 and 36 intersect the paths 32*i* and 32*o* of the inside and outside door levers 30*i* and 30*o*. The five positions are shown in FIGS. 2*a*-2*e*. These five positions thus correspond to lock states of the vehicle door in which the closure latch 10 is installed.

In the first position (FIG. 2*a*), the control member 16 is positioned in a fully retracted position, such that neither of the first or second profiles 34 and 36 intersects the inside and outside door lever paths 32*i* and 32*o*. The first position thus corresponds to a situation wherein movement of the inside and outside door levers 30*i* and 30*o* along their respective paths 32*i* and 32*o* does not cause pivoting of the control member 16 about the pivot axis Acm, and thus does not move the pawl 14 away from its ratchet locking position. Accordingly, the ratchet 12 remains closed. Thus, the first position of the control member 16 corresponds to a situation wherein both the inside and outside door levers 30*i* and 30*o* are disabled. In an embodiment wherein the closure latch 10 is installed in a rear door of a vehicle, this first position of the control member 16 corresponds to a lock state wherein the door lock is locked and the child lock is locked. In an embodiment wherein the closure latch 10 is installed in a front door of a vehicle, this first position of the control member 16 corresponds to a lock state wherein the door lock is locked and the double lock is locked.

In the second position (FIG. 2*b*), the control member 16 is positioned such that the first profile 34 does not intersect the inside door lever path 32*i*, however, the second profile 36 does intersect the outside door lever path 32*o*. The second position thus corresponds to a situation wherein movement of the inside door lever 30*i* along its respective path 32*i* does not cause pivoting of the control member 16 about the pivot axis Acm, and thus does not move the pawl 14 away from its ratchet locking position. However, movement of the outside door lever 30*o* along its respective path 32*o* does cause it to engage the control member 16 and causes the control member 16 to pivot about the pivot axis Acm, thereby moving the pawl 14 to its ratchet unlocking position, thereby permitting the ratchet 12 to release the striker (not shown), which in turn permits the vehicle door to be opened. In an embodiment wherein the closure latch 10 is installed in a rear door of a vehicle, the second position of the control member 16 corresponds to a lock state wherein the door lock is unlocked and the child lock is locked.

In the third position (FIG. 2*c*), the control member 16 is positioned such that the first and second profiles 34 and 36 intersect the inside and outside door lever paths 32*i* and 32*o* respectively. The third position thus corresponds to a situation wherein movement of either the inside or outside door levers 30*i* and 30*o* along their respective paths 32*i* and 32*o* causes the respective door lever 30*i* or 30*o* to engage the control member 16 and pivot the control member 16 about the pivot axis Acm, thereby moving the pawl 14 to its ratchet unlocking position, thereby permitting the ratchet 12 to release the striker (not shown), which in turn permits the vehicle door to be opened. In an embodiment wherein the closure latch 10 is installed in a rear door of a vehicle, the third position of the control member 16 corresponds to a lock state wherein the door lock is unlocked and the child lock is unlocked. In an embodiment wherein the closure latch 10 is installed in a front door of a vehicle, the third position of the control member 16 corresponds to a lock state wherein the door lock is unlocked and the double lock is unlocked.

In the fourth position (FIG. 2*d*), the control member 16 is positioned such that the first profile 34 intersects the inside door lever path 32*i*, however, the second profile 36 does not intersect the outside door lever path 32*o*. The fourth position thus corresponds to a situation wherein movement of the inside door lever 30*i* along its respective path 32*i* causes it to engage the control member 16 and pivot the control member 16 about the pivot axis Acm, thereby moving the pawl 14 to its ratchet unlocking position, thereby permitting the ratchet 12 to release the striker (not shown), which in turn permits the vehicle door to be opened. However, movement of the outside door lever 30*o* along its respective path 32*o* and thus does not move the pawl 14 away from its ratchet locking position. In an embodiment wherein the closure latch 10 is installed in a rear door of a vehicle, the fourth position of the control member 16 corresponds to a lock state wherein the door lock is locked and the child lock is unlocked, thus permitting the inside door handle to be used to override the door lock. In an embodiment wherein the closure latch 10 is installed in a front door of a vehicle, the fourth position of the control member 16 corresponds to a lock state wherein the door lock is locked and the double lock is unlocked, thus permitting the inside door handle to be used to override the door lock.

In the fifth position (FIG. 2*e*) neither of the first or second profiles 34 and 36 intersects the inside and outside door lever paths 32*i* and 32*o*. The fifth position thus corresponds to a situation wherein movement of the inside and outside door levers 30*i* and 30*o* along their respective paths 32*i* and 32*o* does not cause pivoting of the control member 16 about the pivot axis Acm, and thus does not move the pawl 14 away from its ratchet locking position. Accordingly, the ratchet 12 remains closed. Thus, the fifth position of the control member 16 corresponds to a situation wherein both the inside and outside door levers 30*i* and 30*o* are disabled. In an embodiment wherein the closure latch 10 is installed in a rear door of a vehicle, this first position of the control member 16 corresponds to a lock state wherein the door lock is locked and the child lock is locked.

It will be noted that the pivot axis Acm of the control member 16 moves with the control member 16 and is thus independent of the pivot axis Ap of the pawl 14. As a result of the non-coaxial relationship of the two pivot axes Acm and Ap, the slot 24 is sized to accommodate whatever relative movement that takes place during pivoting of the control member 16 and pawl 14 about their respective pivot axes Acm and Ap.

The linearly movable member 28 may be movable along a generally linear path by a linear actuator 38. The linear actuator 38 may include, for example, a stepper motor 40 with an output shaft 42 that is threaded. The output shaft 42 may mate with an internally threaded (i.e. tapped) aperture 44 (FIG. 2*a*) on the linearly movable member 28. The movement of the linearly movable member 28 may be constrained to be linear by elements of the closure latch housing (not shown) so that rotation in one direction or the other of the output shaft 42 drives the linearly movable member 28 forwards or rearwards along its path.

As a result of the available positions of the control member 16, the closure latch 10 may incorporate the same control member 16 and linear actuator 38 for both the front and rear doors of a vehicle. For use in a front door, the control member 16 may be instructed to move only between the third, fourth and fifth positions. For use in a rear door, the control member 16 may be instructed to move between the first, second, third and fourth positions.

Figure 3:
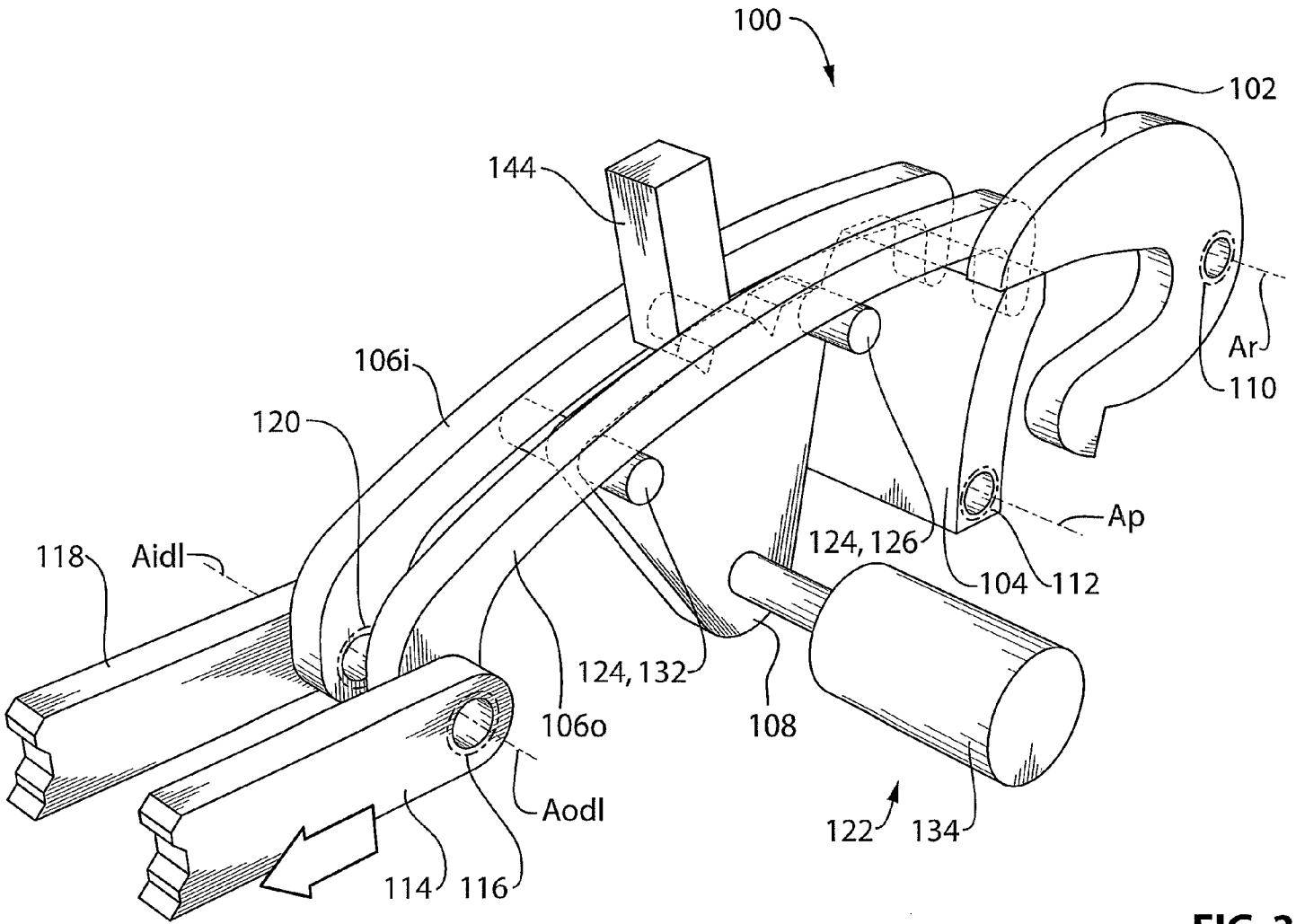
FIG. 3 is a perspective view of a closure latch for a vehicle closure panel in accordance with another embodiment of the present invention, in an unlocked position.

Reference is made to FIG. 3, which shows a closure latch 100 in accordance with another embodiment of the present invention. The closure latch 100 includes a ratchet 102, a pawl 104, an inside door lever 106*i*, an outside door lever 106*o* and a control member 108. The ratchet 102 may be similar to the ratchet 12 (FIG. 1) and is rotatable about a pivot axis Ar between a closed position (FIG. 3) wherein the ratchet 102 is positioned to retain a striker (not shown) and an open position (FIG. 5) wherein the ratchet 102 is positioned to release the striker. The ratchet 102 may be biased towards the open position by a ratchet biasing member 110, which may be any suitable type of biasing member, such as for example, a torsion spring.

Figure 5:
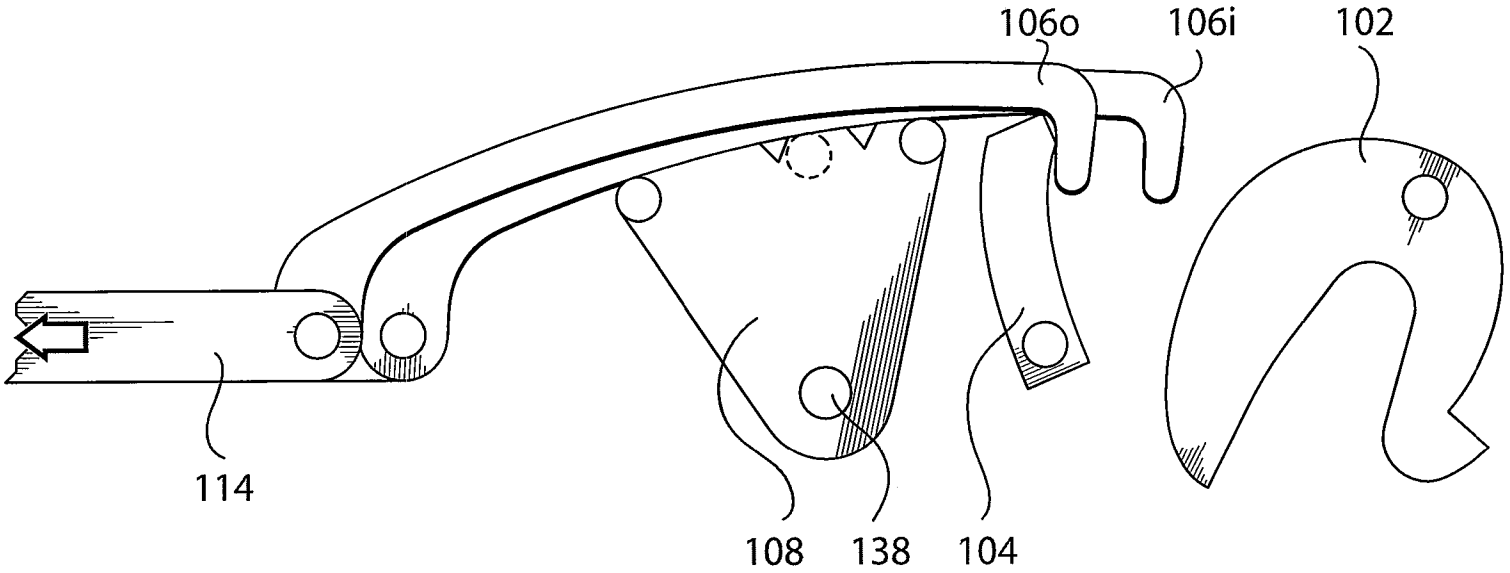
FIG. 5 is a side view of the closure latch shown in FIG. 3, illustrating opening of a vehicle door.

The pawl 104 may be similar to the pawl 14 (FIG. 1) and is rotatable about a pivot axis Ap between a ratchet locking position (FIG. 3) wherein the pawl 104 holds the ratchet 102 in the closed position and a ratchet release position (FIG. 5) wherein the pawl 104 permits the ratchet 102 to move to the open position (FIG. 5). The pawl 104 may be biased towards the ratchet locking position by a pawl biasing member 112, which may be any suitable type of biasing member, such as for example, a torsion spring.

The outside door lever 106*o* is rotatable about an outside door lever pivot axis Aodl between a pawl engagement position (FIG. 3) wherein it is positioned to hook the pawl 104 and a pawl non-engagement position (FIG. 4) wherein it is positioned to avoid hooking the pawl 104. The outside door lever 106*o* may further be movable generally linearly between a rest position shown in FIGS. 3 and 4, and an actuated position (FIG. 5) by an outside door lever actuator 114. When the outside door lever 106*o* is in the pawl engagement position (FIG. 3) and is pulled by the outside door lever actuator 114, it moves the pawl 104 to its ratchet unlocking position (FIG. 5), thereby releasing the ratchet 102. When the outside door lever 106*o* is in the pawl non-engagement position, pulling it to its actuated position does not move the pawl 104 out of its ratchet locking position. The outside door lever actuator 114 may be biased to return the outside door lever 106*o* to its rest position (FIG. 3 or 4).

The outside door lever 106*o* may be biased towards its pawl engagement position (FIG. 3) by an outside door lever biasing member 116, which may be any suitable type of biasing member, such as, for example, a torsion spring.

Figure 4:
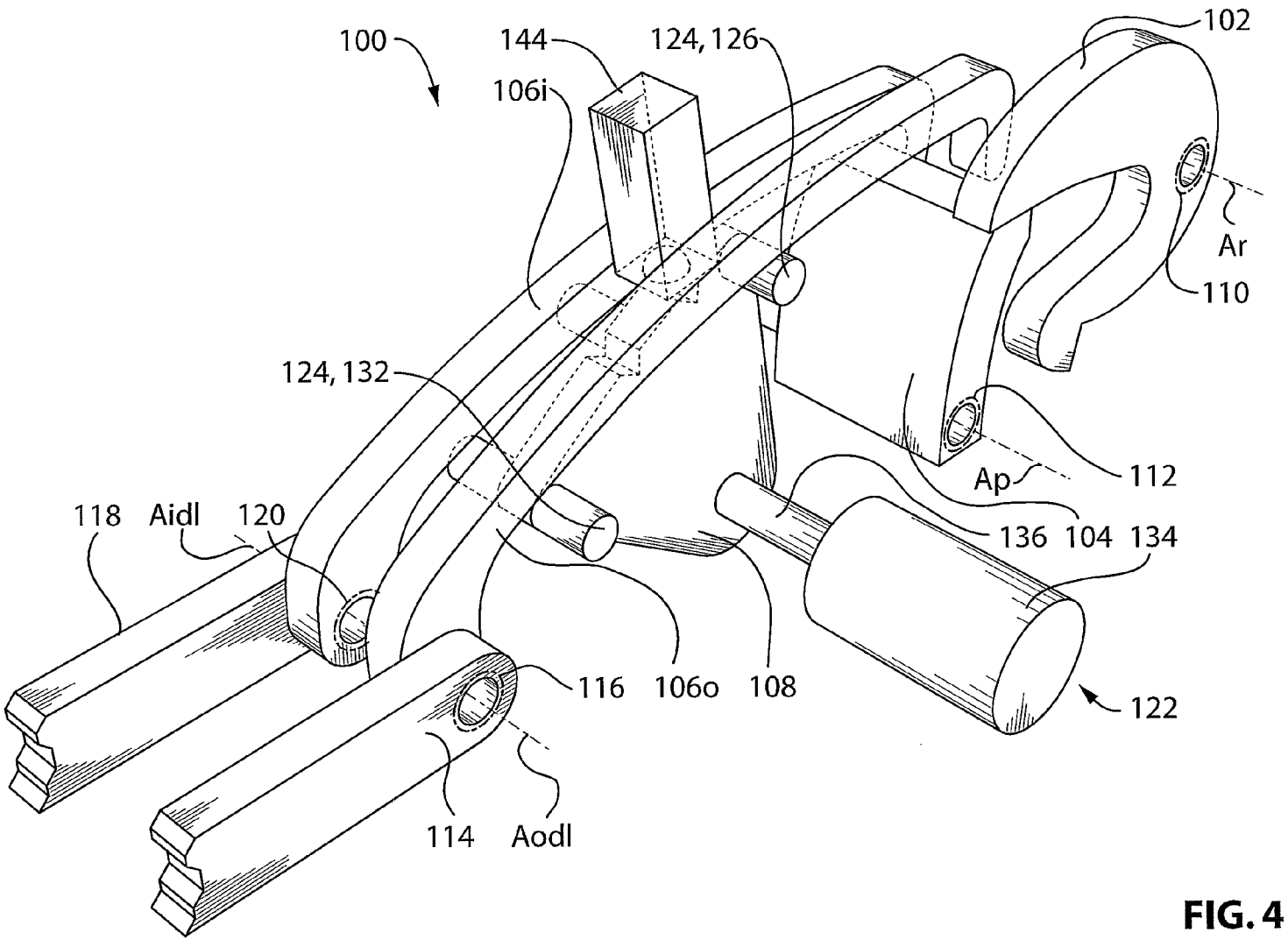
FIG. 4 is a perspective view of the closure latch shown in FIG. 3, in a locked position.

The inside door lever 106*i* may be positioned adjacent the outside door lever 106*o* and may operate similarly thereto, being rotatable about an inside door lever pivot axis Aidl between a pawl engagement position (FIG. 3) where it is positioned to hook the pawl 104 and a pawl non-engagement position (FIG. 4) wherein it is positioned to avoid hooking the pawl 104, and being further movable generally linearly between a rest position shown in FIGS. 3, 4 and 5, and an actuated position (not shown) by an inside door lever actuator 118. When the inside door lever 106*i* is in the pawl engagement position (FIG. 3) and is pulled by the inside door lever actuator 118, it moves the pawl 104 to its ratchet unlocking position (not shown), thereby releasing the ratchet 102. When the inside door lever 106*i* is in the pawl non-engagement position, pulling it to its actuated position does not move the pawl 104 out of its ratchet locking position. The inside door lever actuator 118 may be biased to return the inside door lever 106*i* to its rest position (FIGS. 3, 4 and 5).

The inside door lever 106*i* may be biased towards its pawl engagement position (FIG. 3) by an inside door lever biasing member 120, which may be any suitable type of biasing member, such as, for example, a torsion spring.

Figure 6:
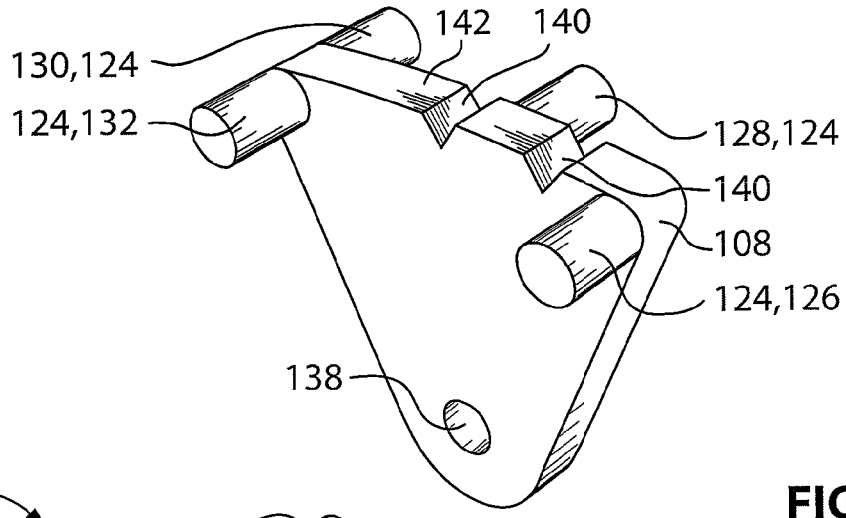
FIG. 6 is a side view of a control member that is part of the closure latch shown in FIG. 3.

The control member 108 is movable to control the operative connection between the inside and outside door levers 106*i* and 106*o* and the pawl 104. In the embodiment shown in FIGS. 3, 4, 5 and 6, the control member 108 is rotatable about a control member pivot axis Acm by a control member actuator 122 to a plurality of positions wherein the control member 108 individually controls whether each of the inside and outside door levers 106*i* and 106*o* is in the pawl engagement position or the pawl non-engagement position. In the embodiment shown in FIG. 3, the control member 108 is oriented for use in a rear door application. Referring to FIG. 6, the control member 108 has a plurality of door lever engagement pins 124 thereon including a door locking pin 126, a child locking pin 128, a first double locking pin 130 and a second double locking pin 132. When the control member 108 is in a first position, shown in FIG. 3, both the inside and outside door levers 106*i* and 106*o* are in their respective pawl engagement positions. Thus the lock state of the closure latch 100 in the first position is: unlocked. When the control member 108 is rotated to a second position (not shown), the outside door lever 106*o* is moved by the door locking pin 126 to its pawl non-engagement position, while the inside door lever 106*i* is in its pawl engagement position. Thus when the control member 108 is in the second position, the door lock is locked and the child lock is unlocked. When the control member 108 is in the third position, the inside door lever 106*i* is held by the child locking pin 128 to its pawl non-engagement position while the outside door lever 106*i* is permitted by the control member 108 to be in the pawl engagement position. Thus when the control member 108 is in the third position, the door lock is unlocked and the child lock is locked. When the control member is in the fourth position, shown in FIG. 4, the inside and outside door levers 106*i* and 106*o* are held in their respective pawl-non-engagement positions. Thus when the control member 108 is in the fourth position, the door lock is locked and the child lock is locked.

In an embodiment wherein the closure latch 100 is used in a front door of a vehicle, the control member 108 may be moved between its first position, which corresponds to a lock state wherein the door lock is unlocked and wherein the double lock is unlocked, its second position, which corresponds to the door lock being locked and the double lock being unlocked, and its fourth position, which corresponds to the door lock being locked and the double lock being locked.

The control member actuator 122 is configured to move the control member 108 to its first, second, third and fourth positions. The control member actuator may include a motor 134, which may be a DC motor and which may further be a stepper motor, with an output shaft 136 which is drivingly connected to the control member 108 in any suitable way. For example, the output shaft 136 of the motor 134 may have a press fit, a spline connection or a key connection with a suitable shaped aperture 138 (FIG. 6) in the control member 108.

To assist the control member 108 in attaining and holding specific rotational positions, the control member 108 may be provided with a plurality of notches 140 on its peripheral edge, shown at 142. The notches 140 each correspond to one of the positions of the control member 108. As the control member 140 is rotated to a selected position, a position-holding device 144 (FIG. 4) such as, for example, a spring biased ball plunger, is provided and engages a notch 140 that is associated with that position on the control member 140. Additionally, limit surfaces may be provided to stop the rotation of the control member 108 at is clockwisemost and counterclockwisemost positions. Accordingly, notches 140 are not required on the control member 108 for these end positions.

Figure 7:
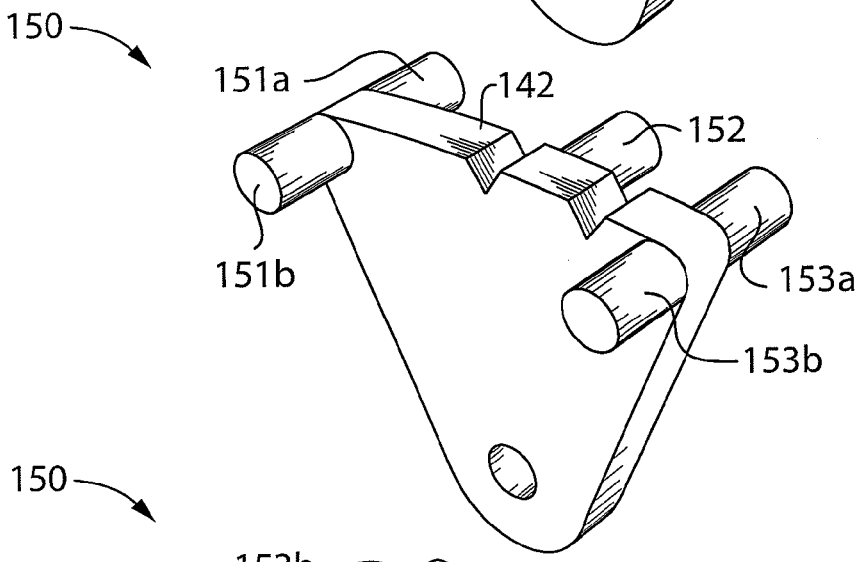
FIG. 7 is a perspective view of an alternative control member for use as part of the closure latch shown in FIG. 3.
Figure 8:
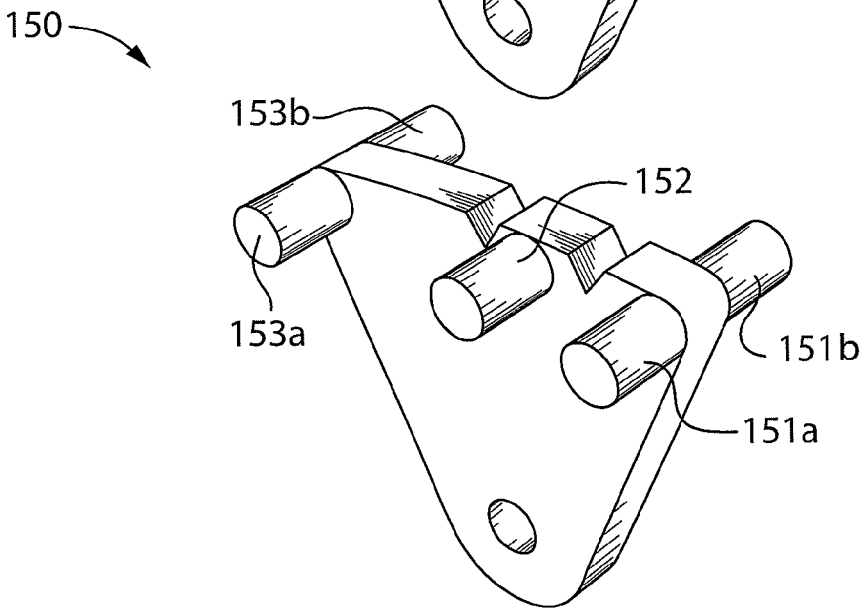
FIG. 8 is a perspective view of the control member shown in FIG. 7, in a second orientation.

Reference is made to FIG. 7, which shows a control member 150 that may be used with the closure latch 100 instead of the control member 108 (FIG. 6). The particular orientation of the control member 150 is suitable for use on a rear door of a vehicle, however, the control member 150 may be reversible and may be flipped to the orientation shown in FIG. 8 for use in a front door. When in the orientation shown in FIG. 7 (i.e. on a rear door), the control member 150 is movable to a first position wherein none of the locking pins on the control member 150 engage the inside or outside door levers 106*i* and 106*o* (FIG. 4), and thus wherein the door is unlocked and the child lock is unlocked; a second position wherein the door lock is locked and the child lock is locked by engagement of locking pins 151*a* and 151*b* with the inside and outside door levers 106*i* and 106*o* respectively; and a third position wherein the door lock is unlocked but the child lock is locked by a locking pin shown at 152. When in the orientation shown in FIG. 8 (i.e. on a front door), the control member 150 is movable to a first position wherein the door is unlocked and the double lock is unlocked, a second position wherein the door lock is locked and the double lock is locked, and a third position wherein the door lock is locked (by the locking pin 152) but the double lock is unlocked. Optionally, the control member 150 may further include another pin (not shown) that would be positioned on the opposite side of the locking pin 152, and would be angularly offset from the pin 152, such that the control member 150 would be positionable in another position that would permit that pin to engage the outside door lever 106*o* permitting the door lock to be locked while the child lock is unlocked.

Figure 9:
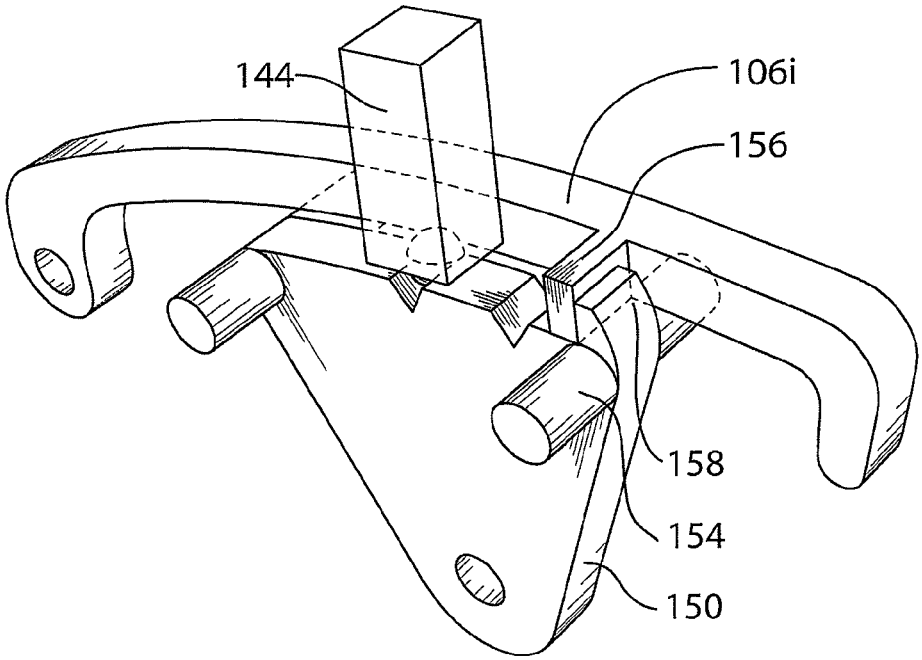
FIG. 9 is a perspective view of the control member shown in FIG. 7 and an alternative inside door lever for use in the closure latch shown in FIG. 3.

The control member 150 further includes safety locking pins 153*a* and 153*b* and is positionable in a safety locking position (shown at FIG. 9) among the positions it can be moved to. The safety locking position is a position in which the control member 150 is positioned when the vehicle's controller determines that a crash is imminent or has taken place (e.g. the air bag has deployed). When this occurs, (i.e. when the vehicle's controller determines that a crash is imminent or has taken place), the control member 150 may be moved to its safety locking position either by the motor 134 (FIG. 4), or preferably by some other suitable means, such as, for example, by a suitable pyrotechnic device (not shown) or a suitable spring mechanism (not shown) or the like.

In the safety locking position, both the inside and outside door levers 106*i* and 106*o* (FIG. 4) are disabled, (similarly to the position of the control member when the child lock and door lock are locked during normal vehicle use (or in the context of a front door, it is similar to when the door lock and the double lock are locked). However, the safety locking position differs in that a reset mechanism shown at 154 in FIG. 9 may be provided that permits the inside door lever 106*i* to be pulled to reset the control member 150 to its unlocked position after the crash event, so that a second pull of the inside door lever 106*i* actuates the pawl 104 and ratchet 102 (FIG. 4) and opens the door, permitting the vehicle occupant to exit the vehicle if desired after the crash event (if the crash event has not otherwise rendered the door unopenable).

The reset mechanism 154 comprises a control member engagement member 156 on the inside door lever 106*i* and an inside lever engagement member 158 on the control member 150. When the inside door lever 106*i* is first pulled, the control member 150 prevents it from engaging the pawl 14 and so the vehicle door is not opened. However, when the inside door lever 106*i* returns to its rest position, the control member engagement member 156 engages the inside lever engagement member 158 and moves the control member 150 from the safety locking position to the unlocked position to permit engagement of the inside door lever 106*i* with the pawl 14. As a result, a second pull of the inside door lever 106*i* moves the pawl 14 and releases the ratchet 12, thereby opening the vehicle door.

While a reset mechanism has been shown which is controlled by the inside door lever 106*i*, it is optionally possible to also provide a second reset mechanism (not shown) to permit the outside door lever 106*o* to be pulled a first time after a crash event to reset the control member 150 and then a second time to open the door.

Figure 10:
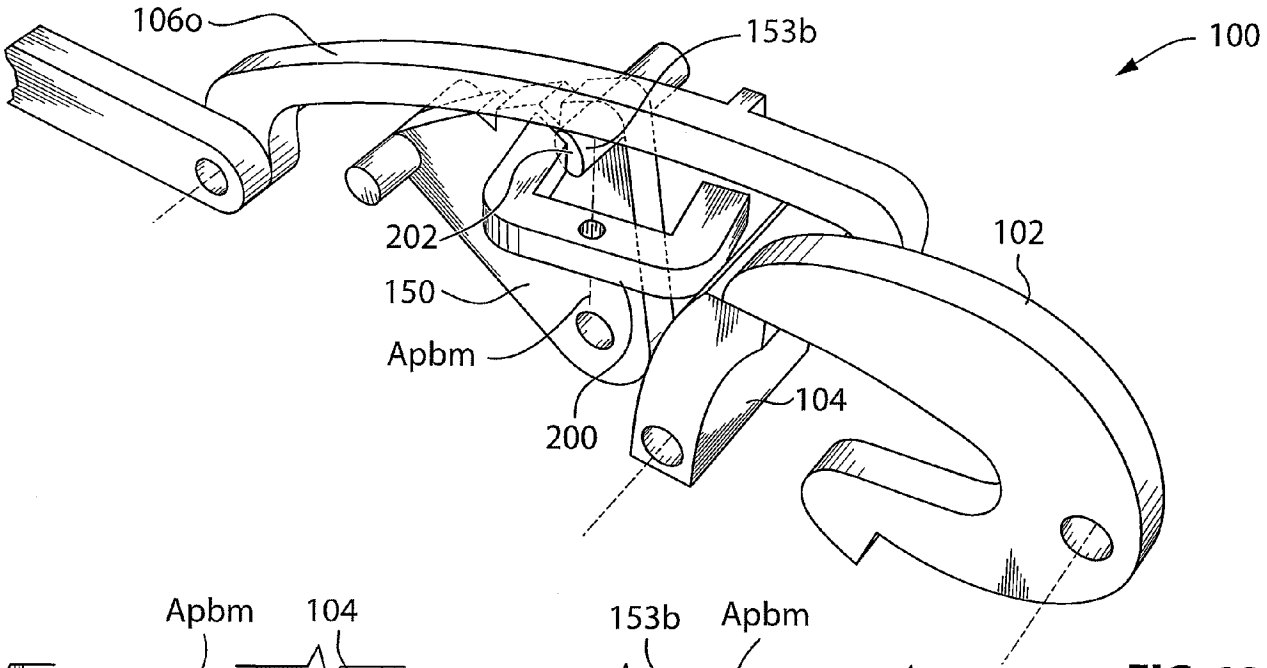
FIG. 10 is a perspective view of the closure latch shown in FIG. 3, with the control member shown in FIG. 7 and with an optional feature for preventing the latch from opening when the vehicle containing the closure latch senses a crash as impending or as occurring.

Reference is made to FIG. 10, which shows the closure latch 100 with an optional pawl blocking member 200, which prevents release of the pawl 104 out of the ratchet locking position when the closure latch 100 is in a safety lock position.

Figure 12:
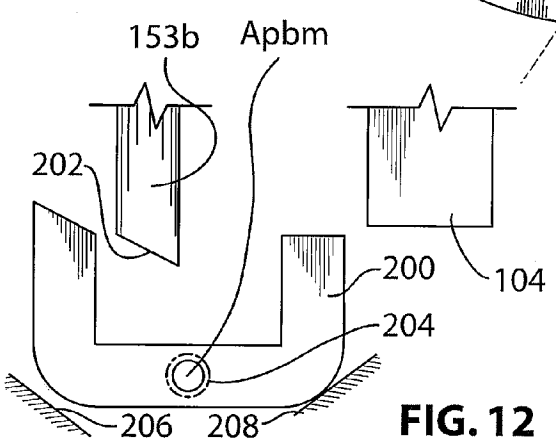
FIG. 12 is a side view of the optional feature shown in FIG. 10, in a pawl unblocking position.
Figure 11:
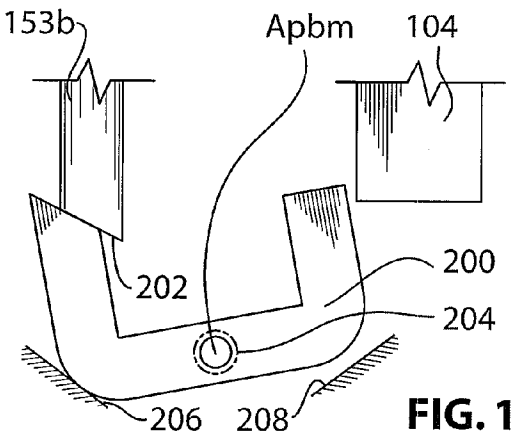
FIG. 11 is a side view of the optional feature shown in FIG. 10, in a pawl blocking position.

When the control member 150 is in the safety locking position a pawl blocking member engagement surface 202 on the control member 150 engages the pawl blocking member 200 and pivots it about a pawl blocking member pivot axis Apbm, to a pawl blocking position (FIG. 11) from a pawl release position (FIG. 12). The pawl blocking member 200 may be biased towards the pawl release position by a pawl blocking member biasing member 204 (FIGS. 11 and 12), which may be any suitable type of biasing member, such as, for example, a torsion spring. The closure latch 100 may include first and second limit surfaces 206 and 208, which limit the travel of the pawl blocking member 200 to between the pawl blocking and pawl release positions. The first and second limit surfaces 206 and 208 may be connected to the closure latch housing.

Figure 13:
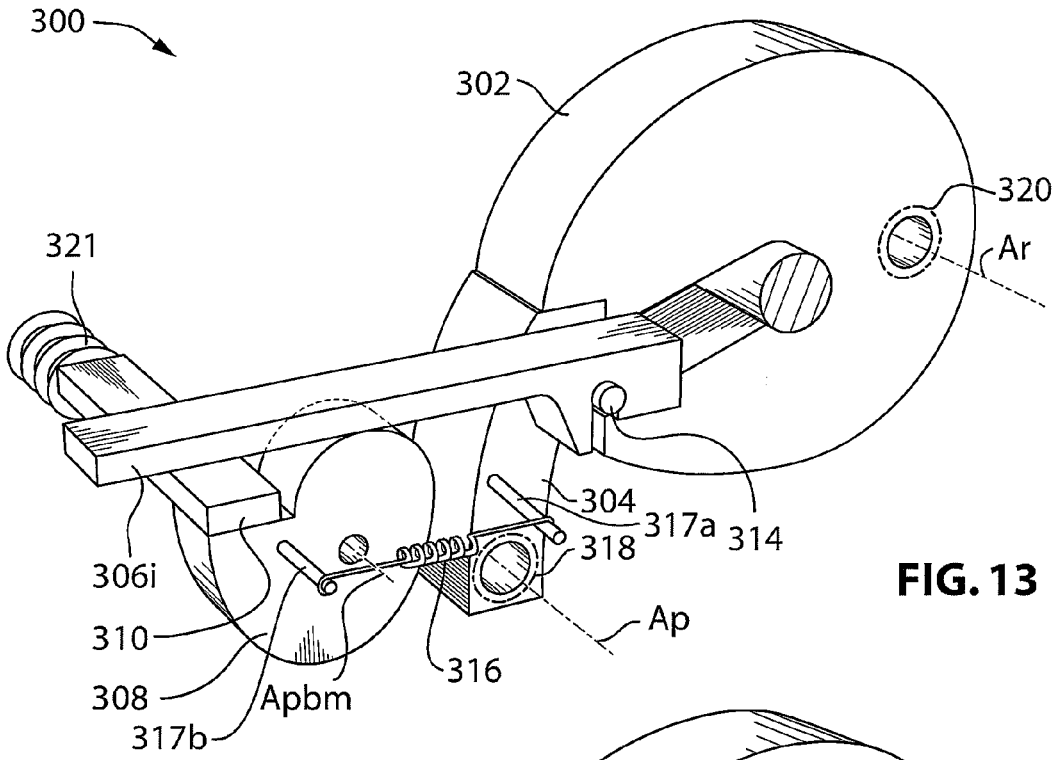
FIG. 13 is a perspective view of a closure latch in accordance with yet another embodiment of the present invention, in an unlocked position.

Reference is made to FIG. 13, which shows a closure latch 300 in accordance with another embodiment of the present invention. The closure latch 300 includes a ratchet 302, a pawl 304, an inside door lever 306*i*, an outside door lever (not shown), a pawl blocking member 308, and a pawl blocking member locking member 310.

FIG. 13 shows the ratchet 302 in the closed position, the pawl 304 in the ratchet locking position and the latch 300 in the unlocked position. When the latch 300 is in the unlocked position, the inside door lever 306*i* is in a pawl engagement position. In the embodiment shown in FIG. 13, a slot 312 on the inside door lever 306*i* captures a pin 314 on the pawl 304. The slot 312 is an example of a pawl engagement member, and the pin 314 is an example of an inside door lever engagement member. It will be understood that the slot 312 could alternatively be on the pawl 304 and the pin 314 could alternatively be on the inside door lever 306*i*. Alternatively, any other suitable pawl engagement member and/or inside door lever engagement member could be used.

The pawl blocking member locking member 310 holds the pawl blocking member 308 in a pawl unblocking position against the bias of a pawl blocking member biasing member 316. When it is desired to open the vehicle door (not shown), the inside door lever 306*i* is pulled, which in turn pulls the pawl 304 to a ratchet release position (shown in dashed outline in FIG. 13) against the biasing of a pawl biasing member 318. The movement of the pawl 304 releases the ratchet 302 which moves to the open position (not shown) at least in part under the urging of a ratchet biasing member 320. The pawl blocking member locking member 310 may be biased towards the pawl blocking member locking position shown in FIG. 13 by a pawl blocking member locking member biasing member 321.

Also, when the latch 300 is in the unlocked position, the pawl blocking member 308 is in a pawl unblocking position, thereby permitting movement of the pawl 304 away from the ratchet locking position. A pawl blocking member biasing member 316, such as a preloaded spring, is configured to hold the pawl blocking member 308 in the pawl unblocking position shown in FIG. 13. The biasing member 316 extends between a first mount 317*a* on the closure latch housing, and a second mount 317*b* that is positioned on the pawl blocking member 308 just to one side (e.g. below) the axis Apbm, so as to bias the pawl blocking member 308 in the counter-clockwise direction in the view shown in FIG. 13. However, a small amount of rotation of the pawl blocking member (clockwise in the view shown in FIG. 13) towards the pawl blocking position would move the second mount 317*b* to a position on the other side of the axis Apbm so that it urges the pawl blocking member 308 towards the pawl blocking position shown in FIG. 14*a*.

Figure 14:
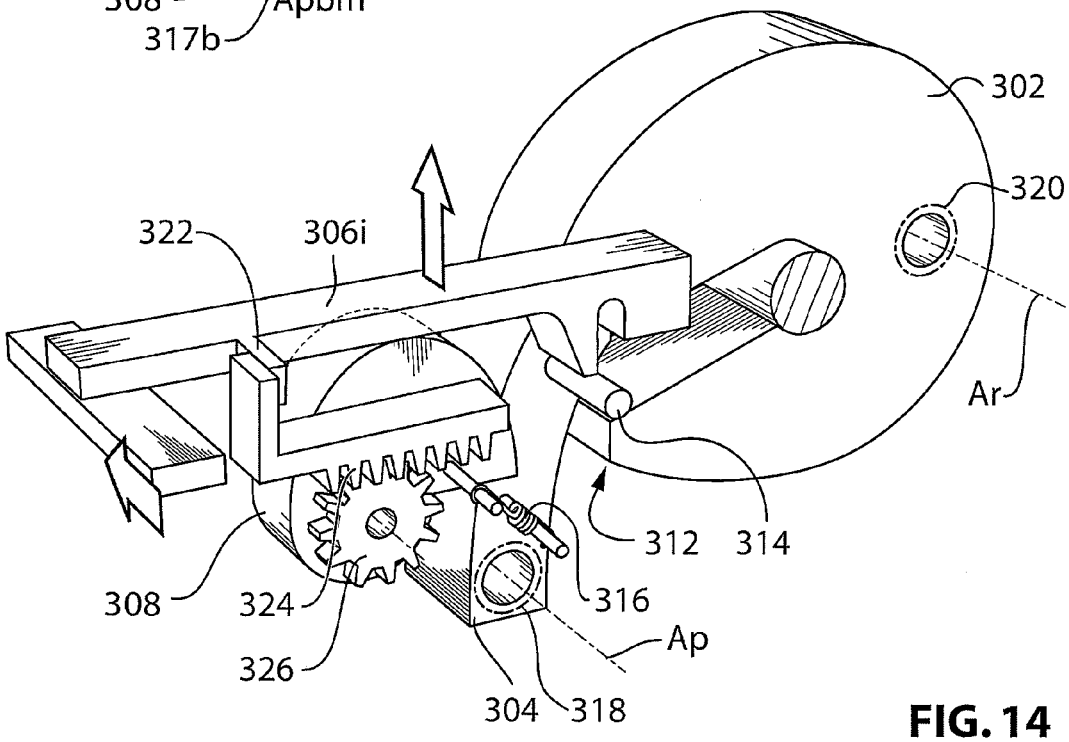
FIG. 14 is a perspective view of the closure latch shown in FIG. 13 in a safety-locked position.
Figure 14A:
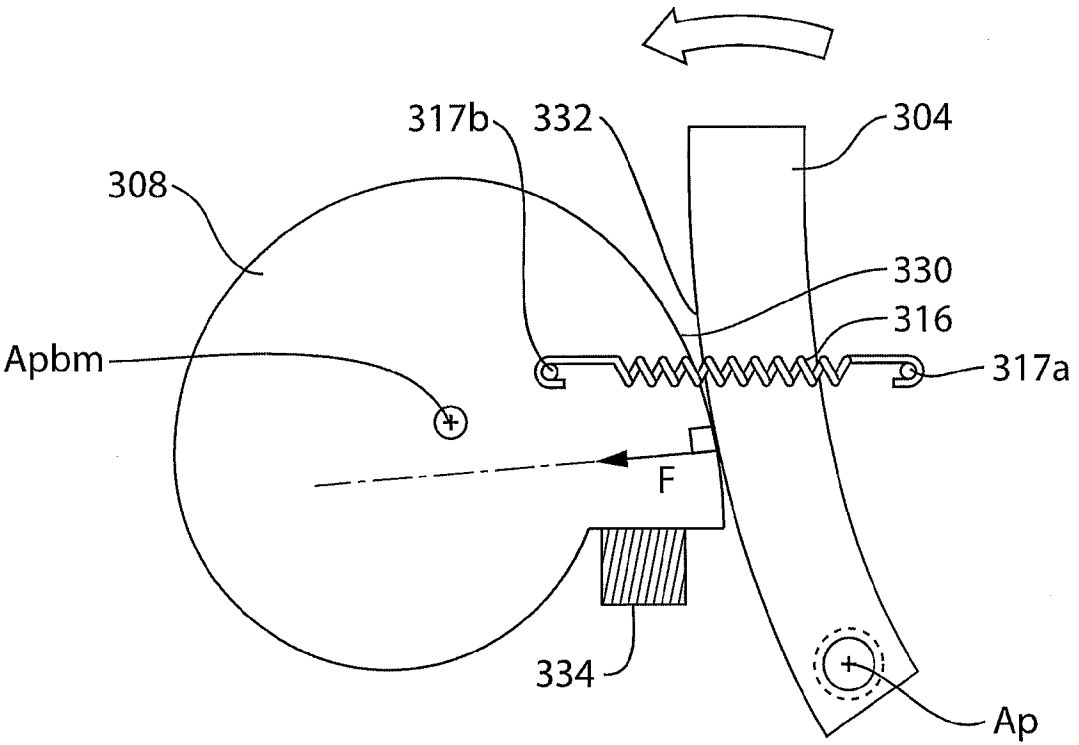
FIG. 14*a* is a side view of the closure latch shown in FIG. 14 showing the interaction between selected components.

As shown in FIG. 14*a*, when the pawl blocking member 308 is in the pawl blocking position, a cam surface 330 thereon engages a cam engagement surface 332 on the pawl 304 and prevents the pawl 304 from rotating in the ratchet release direction. To this end, surfaces 330 and 332 are configured so that the force F exerted on the pawl blocking member 308 by the pawl 304 extends along a direction line that generates a clockwise moment on the pawl blocking member 308 (in the view shown in FIG. 14), thereby urging it against a stop 334 connected to the closure latch housing (not shown).

In addition, when the pawl blocking member 308 is in the pawl blocking position, it disengages the inside door lever 306*i* from its interface with the pawl 304 (i.e. it removes the pin 314 from the slot 312, as shown in FIG. 14. The inside door release lever 306*i* may thus be considered to be in a pawl non-engagement position. As a result, in this configuration the latch 300 is locked and the pawl 304 is blocked and cannot rotate in the ratchet release direction.

If the vehicle controller (not shown) senses an impending crash, or in the event of a sudden deceleration (such as that which is associated with a crash), the pawl blocking member locking member 310 is moved from the locking position shown in FIG. 13 to an unlocking position shown in FIG. 14, and the pawl blocking member 308 is rotated to a pawl blocking position (FIG. 14). At least an initial portion of the movement of the pawl blocking member may be achieved by means of inertia that arises from the deceleration associated with the crash or impending crash, or for example, by means of a trigger device (not shown) or alternatively by means of a pyrotechnic device (not shown). Movement of the pawl blocking member 308 to the pawl blocking position locks the pawl 304 in the ratchet locking position (FIG. 14) and also moves the inside door lever 306*i* to the pawl non-engagement position (FIG. 14). As a result, the pawl 304 has an increased likelihood of holding the ratchet 302 in the closed position during a crash.

Figure 15:
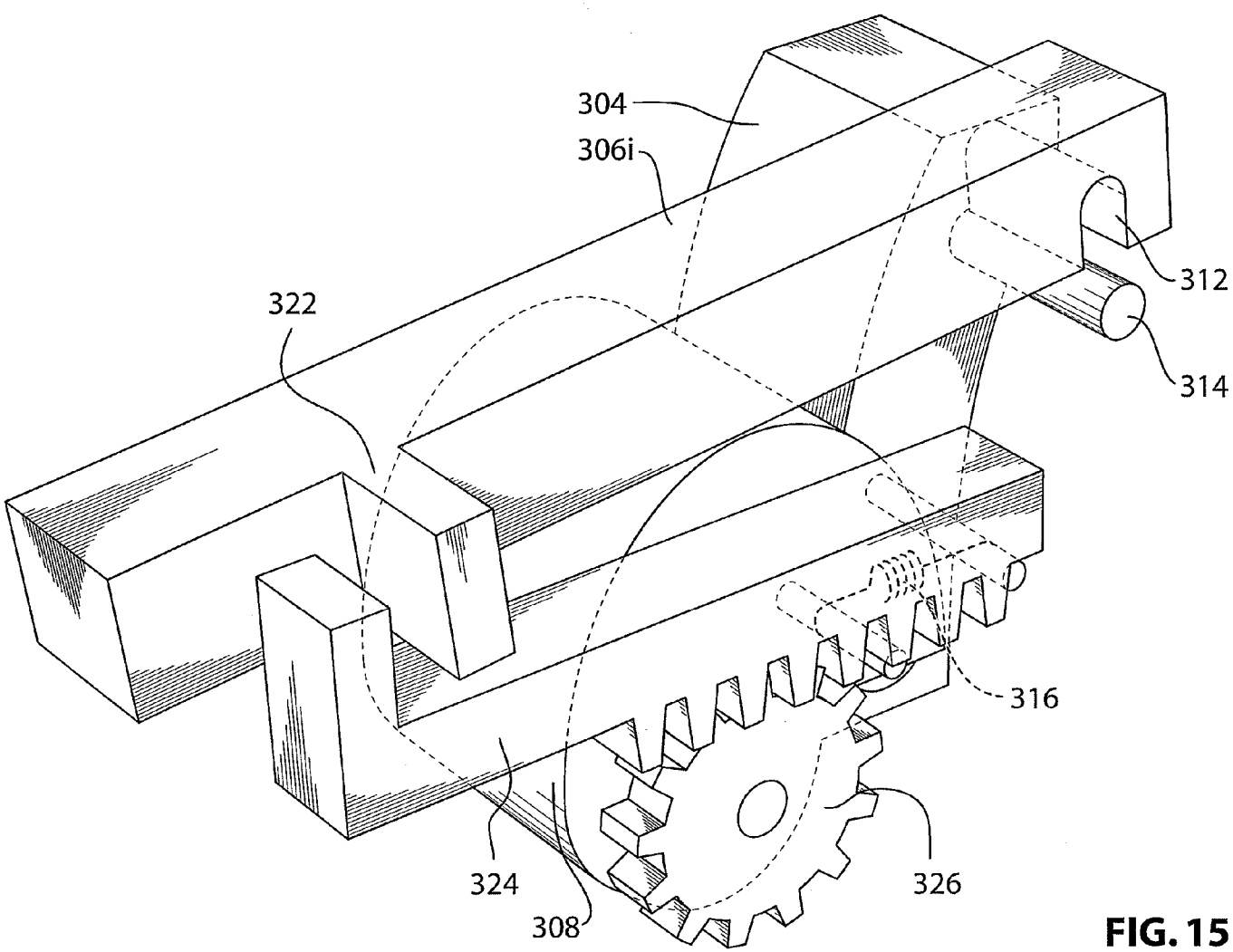
FIG. 15 is another perspective view of the closure latch shown in FIG. 13 in a safety-locked position, showing additional components.

After a crash, to reset the latch 300 to the unlocked state, a rack/pinion arrangement can be used. Referring to FIG. 15, upon pulling the inside door lever 306*i* to its full travel position, a rack engagement member 322 on the inside door lever 306*i* moves a rack 324, which in turn rotates a gear 326 that is connected to the pawl blocking member 308, thereby rotating the pawl blocking member 308 from the pawl blocking position (FIG. 15) to the pawl unblocking position (FIG. 13) wherein it is held by the biasing member 316. Once the pawl blocking member 308 is rotated to its pawl unblocking position, the inside door lever 306*i* can move to its pawl engagement position. As a result, a second pull of the door lever 306*i* pulls the cam 304 to its ratchet release position. The rack 324 remains in a retracted position until it is advanced to the position shown in FIG. 14 by interaction with the gear 326 in an event that brings the pawl blocking member 308 to its blocking position. When it is in the retracted position, the inside door lever 306*i* would thus not typically engage the rack 324, because the inside door lever 306*i* would typically move the pawl 304 to release the ratchet 302 prior to reaching a position wherein it would engage the rack 324.

It will be understood, that an outside door lever could be provided with similar structure to the inside door lever 306*i*, permitting a user to pull thereon two times to release the associated vehicle door when the latch 300 is in a safety locking position.

Figure 16:
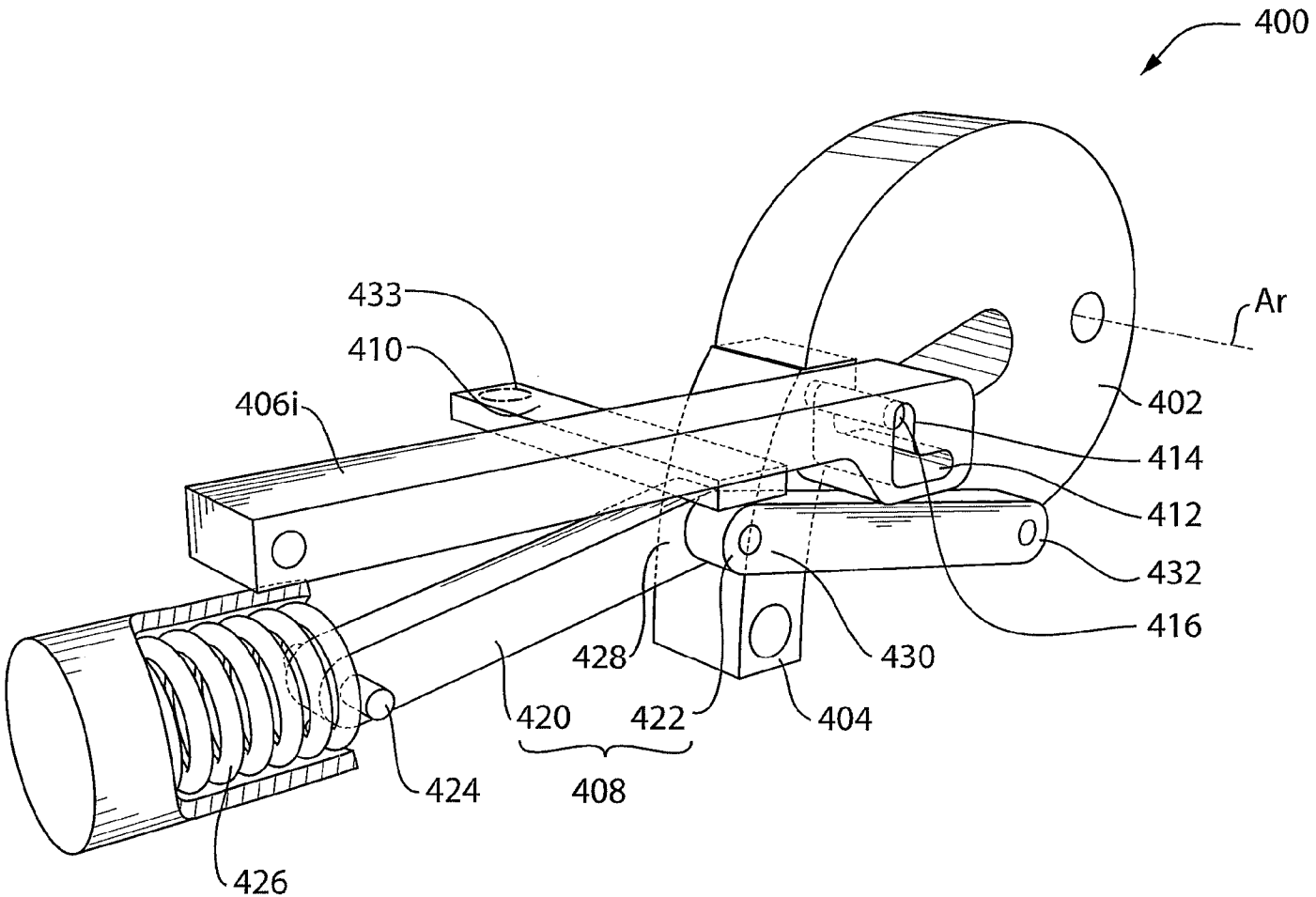
FIG. 16 is a perspective view of a closure latch in accordance with yet another embodiment of the present invention, in an unlocked position.
Figure 17:
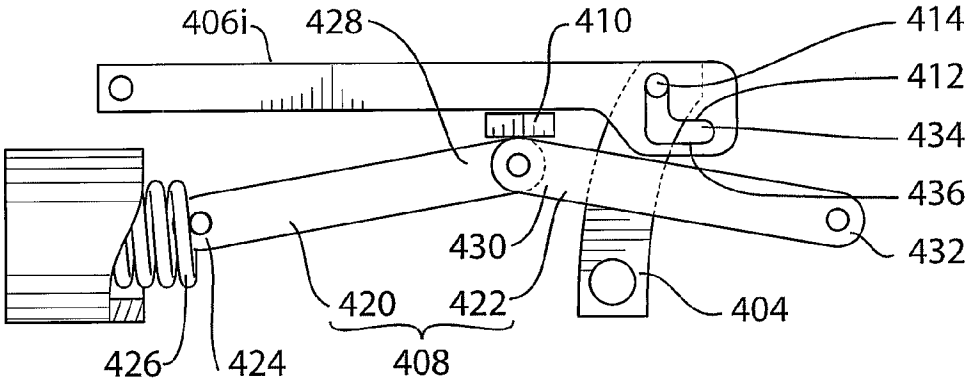
FIG. 17 is a side view of the closure latch shown in FIG. 16 in the unlocked position.
Figure 18:
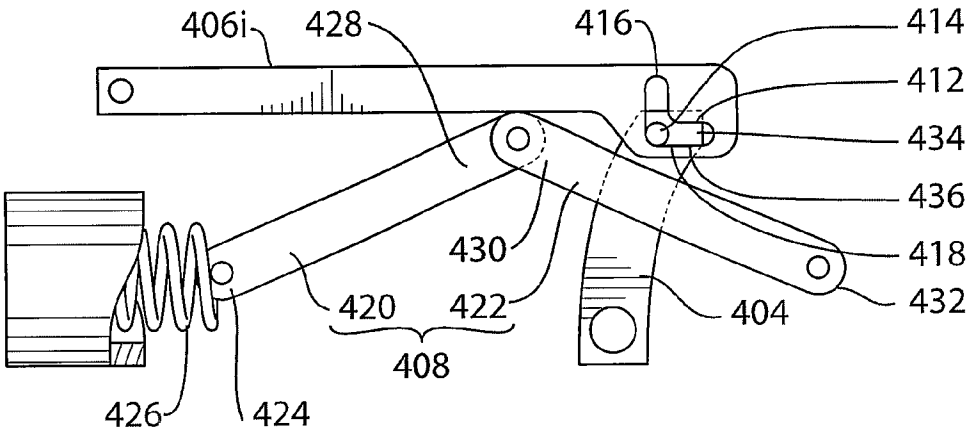
FIG. 18 is a perspective view of the closure latch shown in FIG. 13 in a safety-locked position.

Reference is made to FIG. 16 in which a vehicle latch 400 is shown in accordance with another embodiment of the present invention. The vehicle latch 400 may include a ratchet 402, a pawl 404, an inside door lever 406*i*, a pawl blocking member 408, a pawl blocking member locking member 410. The inside door lever 406*i* includes an L-shaped slot 412 that is engaged by a pin 414 on the pawl 404. The inside door lever 406*i* is movable between a pawl engagement position (FIGS. 16 and 17) and a pawl non-engagement position (FIG. 18). When the inside door lever 406*i* is in the pawl engagement position, the pin 414 is at the top end 416 of the L-shaped slot 412. As a result, when the inside door lever 406*i* is pulled it pulls the pawl 404 from its ratchet locking position (FIGS. 16 and 17) to a ratchet release position (not shown). When the inside door lever 406*i* is in a pawl non-engagement position (FIG. 18), the pin 414 is at the corner 418 of the L-shaped slot 412 (which is described in further detail below).

The pawl blocking member 408 is movable from a pawl unblocking position (FIGS. 16 and 17) to a pawl blocking position (FIG. 18). In the pawl unblocking position, the pawl blocking member 408 permits the engagement of the inside door lever 406*i* and the pawl 404, and permits the movement of the pawl 404 from the ratchet locking position (FIGS. 16 and 17) to the ratchet release position (not shown). In the pawl blocking position (FIG. 18), the pawl blocking member 408 moves the inside door lever 406*i* to its pawl non-engagement position (FIG. 18), and also blocks the movement of the pawl 404 out of the ratchet locking position.

The pawl blocking member 408 may include a first link 420 and a second link 422. The first link 420 has a first end 424 that is pivotally connected to a pawl blocking member biasing member 426, and has a second end 428 that is pivotally connected to a first end 430 of the second link 422. The second link 422 further includes a second end 432 that is pivotally connected to a stationary member such as the latch housing (not shown). The pawl blocking member biasing member 426 biases the pawl blocking member 408 to the pawl blocking position shown in FIG. 18.

The pawl blocking member locking member 410 is movable between a pawl blocking member locking position (FIGS. 16 and 17) and a pawl blocking member release position (FIG. 18). In the pawl blocking member locking position, the pawl blocking member locking member 410 holds the pawl blocking member 408 in the pawl unblocking position. In the pawl blocking member unlocking position, the pawl blocking member locking member 410 permits the movement of the pawl blocking member 408 to the pawl blocking position (FIG. 18).

The pawl blocking member locking member 410 may pivot in a plane that is generally perpendicular to the plane of movement of the ratchet 402, pawl 404, inside door lever 406*i* and pawl blocking member 408. The pawl blocking member locking member 410 may be biased towards the pawl blocking member locking position (FIGS. 16 and 17), by a pawl blocking member locking member biasing member 433 (FIG. 16).

If the vehicle controller (not shown) senses an impending crash, or in the event of a sudden deceleration (such as that which is associated with a crash), the pawl blocking member locking member 410 is moved from the pawl blocking member locking position to the pawl blocking member unlocking position, permitting the pawl blocking member 408 to move to the pawl blocking position under the urging of the pawl blocking member biasing member 426. The movement of the pawl blocking member locking member 410 may be achieved by means of inertia that arises from the deceleration associated with the crash or impending crash, or for example, by means of a trigger device (not shown) or alternatively by means of a pyrotechnic device (not shown).

During the crash, resistance to movement of the pawl 404 away from the ratchet locking position is provided in part by the pawl biasing member (not shown) and in part by the pawl blocking member biasing member 426. For this purpose, the pawl blocking member biasing member 426 may be configured to be relatively stiff (e.g. it may be configured to have a relatively high spring constant) such that it would require a force of 100N or more to compress. After a crash, to open the vehicle door (not shown), the inside door lever 406*i* may be pulled. Referring to FIG. 18, when the inside door lever 406*i* is pulled it moves (towards the left in the view shown in FIG. 18), but the pin 414 and therefore the pawl 404 are not moved by it. Instead, when the inside door lever 406*i* is pulled, the pin 414 slides from the corner 418 towards the free end, shown at 434, of the lower portion, shown at 436, of the L-shaped slot 412. As a result, the vehicle door is not opened). However, pulling the inside door lever 406*i* moves the pawl blocking member 408 back to its pawl unblocking position against the urging of the pawl blocking member biasing member 426. Once in that position, the pawl blocking member locking member 410 can move to the pawl blocking member locking position (FIGS. 16 and 17) under the urging of the pawl blocking member locking member biasing member 433. When the inside door lever 406*i* is released, and moves back to its rest position, the pin 414 returns from the free end 434 of the lower slot portion 436 to the corner 418. Once the pin 414 reaches the corner 418, the inside door lever 406 is free to move downwards to its pawl engagement position, because it is no longer engaged by the pawl blocking member 408. As a result, the inside door lever 406*i* moves to its pawl engagement position wherein the pin 414 is returned to the top end 416 of the L-shaped slot 412.

It will be understood, that an outside door lever could be provided with similar structure to the inside door lever 406*i*, permitting a user to pull thereon two times to release the associated vehicle door when the latch 400 is in a safety locking position.

While the above description constitutes a plurality of embodiments of the present invention, it will be appreciated that the present invention is susceptible to further modification and change without departing from the fair meaning of the accompanying claims.

The invention claimed is:

1. A closure latch for a vehicle closure panel, comprising:

a ratchet rotatably movable between an open position adapted to be released from a striker on the closure panel and a closed position adapted to retain the striker on the closure panel;

a pawl pivotally movable between a ratchet release position spaced from the ratchet and permitting the ratchet to move to the open position and a ratchet locking position engaged with the ratchet and holding the ratchet in the closed position;

an outside door lever operatively coupled between an outside door handle and the pawl, the outside door lever having a first proximal end pivotally coupled to the outside door handle and an opposite second distal end selectively engageable with the pawl;

an inside door lever spaced from and parallel to the outside door lever and operatively coupled between an inside door handle and the pawl, the inside door lever having a first proximal end pivotally coupled to the inside door handle and an opposite second distal end selectively engageable with the pawl; and a control member operatively coupled to each of the inside and the outside door levers between the respective first and second ends thereof, the control member positionable in at least three positions corresponding to at least three different states of operative connection between the inside and the outside door levers and the pawl, wherein each of the inside and the outside door levers is selectively and independently pivotally movable in response to rotation of the control member between an engagement position engaged with the pawl for actuating the pawl to the ratchet release position and thereby permitting movement of the ratchet to the open position and a non-engagement position spaced from and operatively disconnected from the pawl for maintaining the pawl in the ratchet locking position and thereby holding the ratchet in the closed position.

2. A closure latch as claimed in claim 1, wherein the at least three positions include a first position wherein the control member prevents an operative connection between the inside door lever and the pawl and between the outside door lever and the pawl, a second position wherein the control member operatively connects one of the inside and the outside door levers and the pawl, and a third position wherein the control member operatively connects both the inside and the outside door levers and the pawl.

3. A closure latch as claimed in claim 1, wherein the control member is operatively connected to the pawl, and wherein movement of the control member to any of the at least three positions determines whether an operative connection is present between the inside door lever and the control member and between the outside door lever and the control member.

4. A closure latch as claimed in claim 2, wherein the control member is rotatable to the at least three positions.

5. A closure latch as claimed in claim 4, wherein rotation of the control member in a first direction pivots one of the outside and the inside door levers from the engagement position operatively connecting the respective outside and inside door lever with the pawl to the non-engagement position operatively disconnected from the pawl and rotation of the control member is a second direction opposite the first direction pivots both of the outside and the inside door levers from the engagement position operatively connecting the outside and inside door levers with the pawl to the non-engagement position operatively disconnected from the pawl.

6. A closure latch as claimed in claim 5, further comprising a motor for moving the control member between the at least three positions.

7. A closure latch as claimed in claim 1, wherein one of the at least three positions is a safety locking position, wherein when the control member is in the safety locking position, at least one of the door levers is movable once to move the control member to an unlocking position, and wherein the at least one of the door levers is movable a second time to move the ratchet to the open position.

* * * * *